US005358253A

United States Patent [19]

Chen

[11] Patent Number: 5,358,253

[45] Date of Patent: Oct. 25, 1994

[54] LIGHT AND SOUND EMITTABLE DARTSBOARD

[76] Inventor: Sheng-kun Chen, No. 20, Alley 73, Lane 231, Chung-chen Road, Tou Fen Down, Miao Li Hsien, Taiwan

[21] Appl. No.: 980,699

[22] Filed: Nov. 24, 1992

[51] Int. Cl.[5] ..... F41J 3/02

[52] U.S. Cl. ..... 273/344; 273/371

[58] Field of Search ..... 273/371, 372, 344

[56] References Cited

U.S. PATENT DOCUMENTS

| | | | |
|---|---|---|---|
| 2,118,368 | 5/1938 | Tyllyer | 273/371 X |
| 3,455,553 | 7/1969 | Melvin | 273/344 |
| 3,508,752 | 4/1970 | Lemon | 273/371 X |

*Primary Examiner*—William H. Grieb
*Attorney, Agent, or Firm*—Bacon & Thomas

[57] ABSTRACT

The present invention relates to a light and sound emittable dartsboard which has a bottom member on which a central induction board, a cell compartment, speakers, etc. are disposed, a top member which is adapted to be covered over the bottom member and may have a top protective layer showing different patterns. The bottom member has a plurality of bulbs disposed around its periphery such that each of the bulbs may project from a hole correspondingly formed on the top member. The top member has a switch control means the lower end of which is shortly above the induction board such that the switch control means shall contact the induction board and connect the circuit thereof when the switch control means is hit by a dart. At this point, the dartsboard shall emit preset sound and the bulbs shall flash at random for a period of time before all of them but one extinguish. The bulb that keeps on shall indicate a certain score or mark as shown on the top protective layer corresponding to the lighting bulb.

4 Claims, 4 Drawing Sheets

LIGHT AND SOUND EMITTABLE DARTSBOARD

BACKGROUND OF THE INVENTION

The present invention relates to a light and sound emittable dartsboard, more particularly to a dartsboard which may emit flashes of light and/or sound for a predetermined period of time and lighten at random any bulbs thereon when a dart hits it at the center.

Following the westernization of our life style nowadays, more and more western style entertainment places, such as pubs, are locally found everywhere now. In such pubs, various kinds of indoor activities, including darts, are provided in addition to drinks, foods, and relaxed chat environment and are enjoyed by most people there. For darts, it is a game which can be played at any place and it is therefore a very good indoor activity and has even become a family entertainment.

The standard equipments for general darts include a dartsboard usually fixed to a wall and a plurality of darts for shooting the board. Generally, the board is divided into several sectors which may be further divided into different areas by several concentric circles. The areas may be then differently colored to represent different scores that can be obtained by the player in the games.

Even the board can be differently divided and/or the game may be differently played and scored, the game itself is, however, static and has limited fun. That is, even the center of the board is excitingly hit, the board itself is silent and can not create any cheerful air. Moreover, the scores which can be got by hitting different areas are already known and are therefore less attractive.

SUMMARY OF THE INVENTION

It is therefore a primary object of the present invention to provide a dartsboard which mainly consists of a bottom member on which some major elements, such as induction board, speakers, cell compartment, etc., are disposed and flash bulbs are circumferentially arranged; and a top member which is adapted to cover over the bottom member and has through holes formed at its circumference corresponding to the flash bulbs on the bottom member and a central opening for receiving a switch control means which, when being depressed under external force, shall electrically connect the dartsboard, causing the same to emit sound and flash the bulbs for a certain period of time before a score or mark is indicated by specially designed display.

BRIEF DESCRIPTION OF THE INVENTION

The other objects and characteristics of the present invention may be best understood through the following detailed description of the preferred embodiment and the accompanying drawings wherein FIG. 1 illustrates an assembled dartsboard which is an embodiment of the present invention, and an associated dart thereof which is about to be thrown out;

DETAILED DESCRIPTION OF THE PREFERRED EMBODIMENTS

Figure 1:
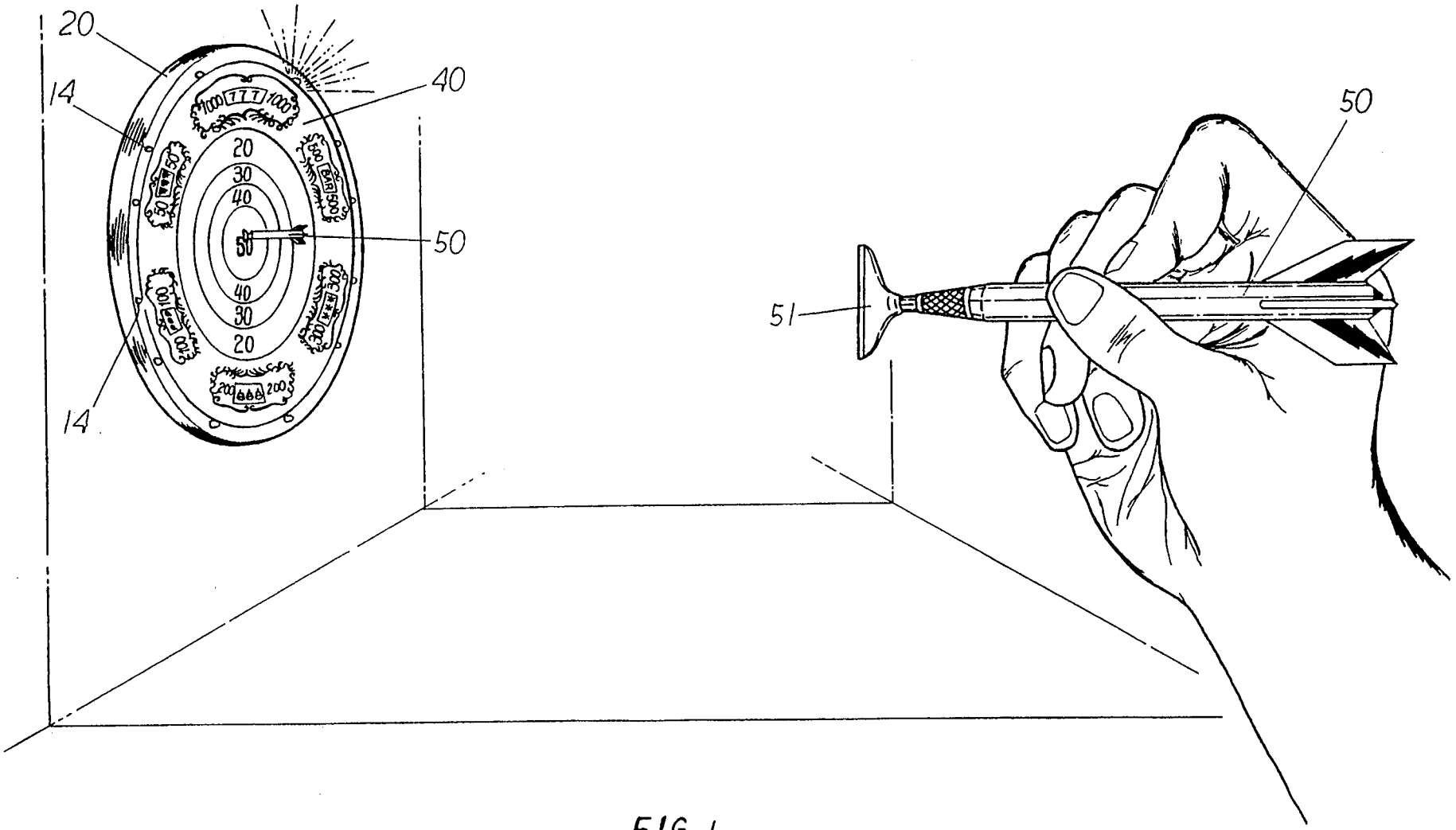
Figure 2:
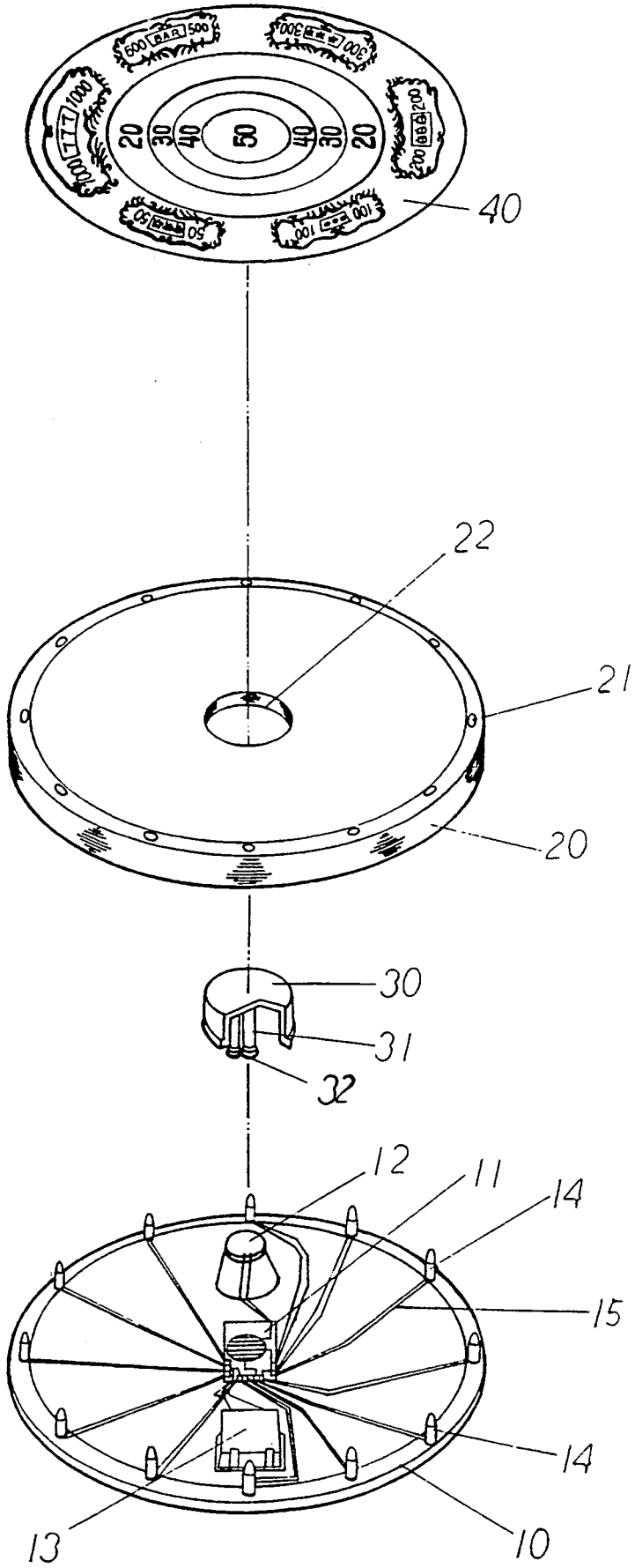
FIG. 2 is an analytical perspective of the dartsboard shown in FIG. 1.

Please refer to FIGS. 1 and 2, the present invention mainly consists of a bottom member 10, a top member 20, a switch control means 30, and a surface layer 40. A central induction board 11, an offset speaker 12, and a battery compartment 13 are separately disposed on top surface of the bottom member 10 at adequate positions; a plurality of bulbs 14 are circumferentially arranged near the periphery of the bottom member 10 and are connected to the central induction board 11 by means of wires 15.

The top member 20 is adapted to cover over and thereby join with the bottom member 10 to form an integral piece. Through holes 21 are formed near the periphery of the top member 20 at positions corresponding to the bulbs 14 on the periphery of the bottom member 10 so that the bulbs 14 may separately pass through the through holes 21 and project out of top surface of the top member 20. A central opening 22 is provided at the center of the top member 20 to receive the switch control means 30 and allow the same to downward pass through such that the switch control means 30 locates just above and shortly away from the induction board 11. Inside the switch control means 30, there is provided with a plurality of downward extending legs 31 which each has an elastic lower end 32. Inside each of the elastic lower ends 32, a conductive contact piece 33 is disposed at a proper distance away from the lower end 32.

The surface layer 40 is adapted to paste on and thereby protect the outer surface of the top member 20 and may be designed to have different scores or decorative patterns thereon.

As shown in FIG. 1, a dart 50 having a suction cup 51 disposed at the dart head is preferably used in the game to achieve better effect. The dart 50 is so designed that it may, after being thrown toward the dartsboard, firmly attach to the top surface of the dartsboard and effectively depress the same to the extent that the switch control means 30 can be electrically connected under the pressure.

Figure 3:
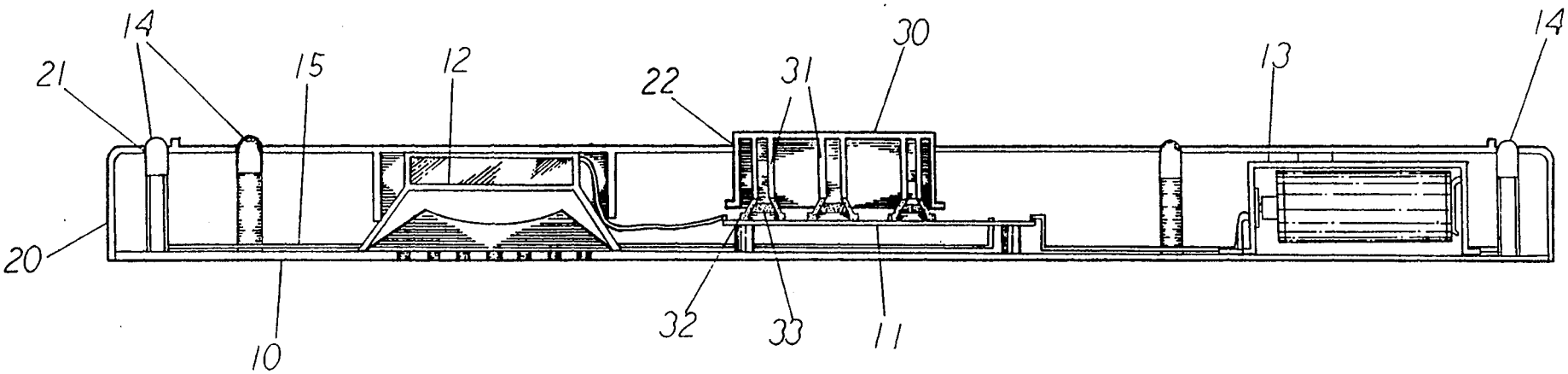
FIG. 3 is a vertically sectional view of the dartsboard assembled from the elements shown in FIG. 2.

As shown in FIG. 3, When the center of the dartsboard is hit by a dart 50, the switch control means 30 disposed thereat in advance shall be pushed backward by the impulse of the dart 50. At this point, the elastic lower ends 32 of the legs 31 of the switch control means 30 shall be flatened which causes the conductive contact pieces 33 inside the elastic lower ends 32 to contact the induction board 11 and thereby closes the circuit for the dartsboard of the present invention.

Figure 4:
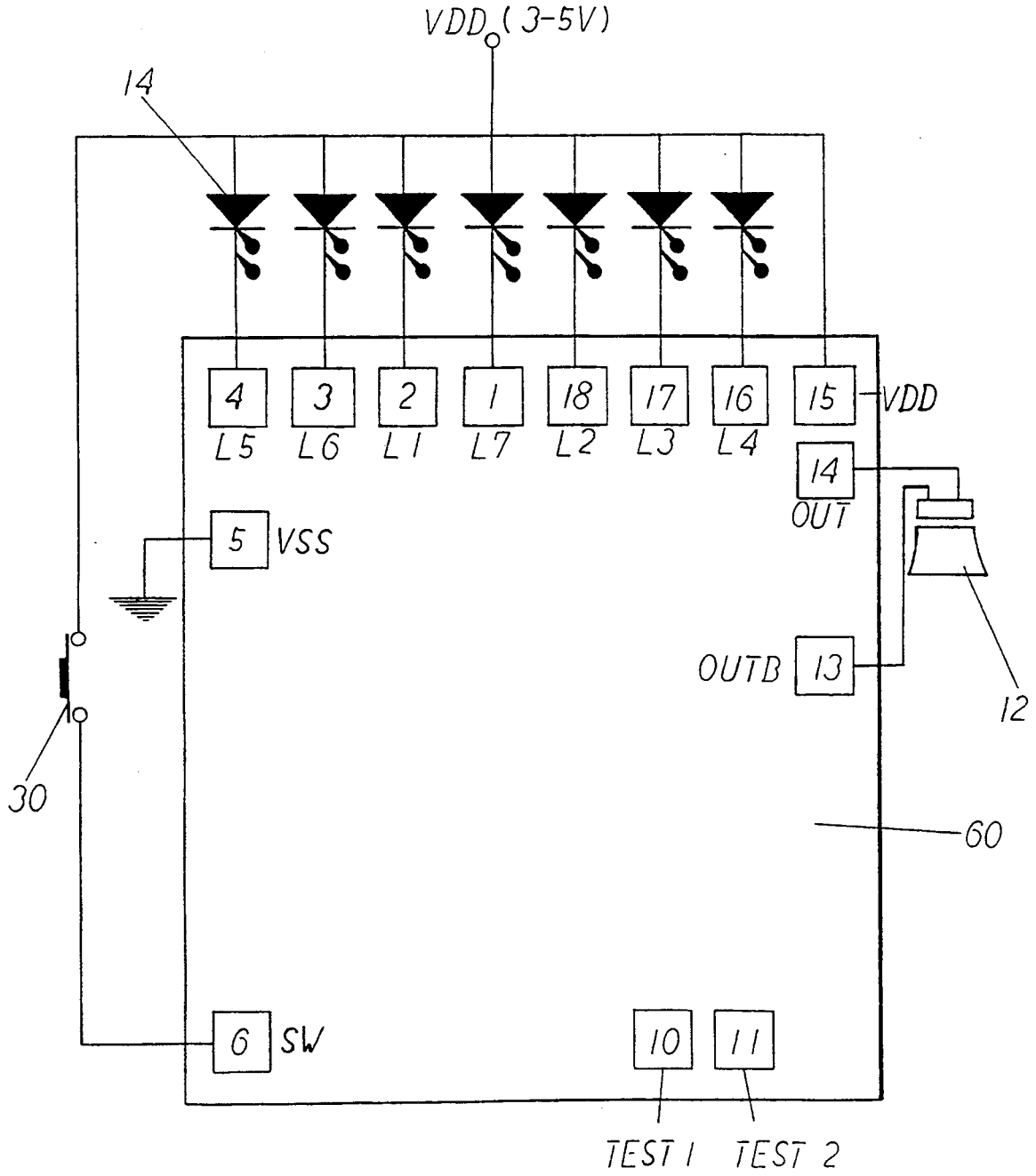
FIG. 4 is a circuit diagram adopted by the dartsboard according to the present invention.

Please now refer to FIG. 4, a micro control IC 60 is preset on the induction board. In this circuit 60, an activation circuit, an LED driving circuit, a sequence circuit, and other related circuits for sound emitting and time counting are preset. Thus, when the switch control means 30 is downward pushed and causes the switch SW to activate, various kinds of preset sound, such as cheers, may be emitted by means of programs determined in advance. The bulbs 14 (also the LEDs) may at this point flash at random and for a certain period of time before all of them but one automatically extinguish when the time counting circuit is programmably activated. At this point, one of the changing scores or marks indicating different scores can be shown at random in a specific area.

When the switch control means 30 is released from the forward impulse from the dart 50, the elastic lower ends 32 thereof may automatically spring back to their original position. At this point, the conductive contact pieces 33 inside the lower ends 32 move away from the induction board 11 and the dartsboard is ready for next game and will show light and sound again when another dart hits it.

Since the switch control means 30 preset at center of the dartsboard may close the circuit therein and cause the emission of flashes of light and sound in different manners when a dart 50 hits the center thereof, it enables the originally static darts to be more interesting and attractive. Moreover, an unexpected score may be shown in a specific area indicated by one of the bulbs when it has flashed together with other bulbs at random and for a certain period of time and finally becomes the only bulb keeping lighted. That is, the player always gets an unexpected scores that means higher challenge in the game. The present invention is therefore a new and surprisingly interesting light and sound emittable dartsboart when comparing with conventional static dartsboards.

I claim:

1. A light and sound emittable dartsboard comprising a bottom member on which a central induction board, a cell compartment, speakers, and other related items are preset;

a top member which is adapted to be covered over said bottom member and thereby join with said bottom member; and a surface layer of patterns for covering and protecting top surface of said top member;

said dartsboard being characterized by that said bottom member has a plurality of bulbs disposed near outer periphery thereof such that said bulbs each may project out of a through hole correspondingly formed on said top member; and that said top member has a switch control means received in a central opening formed on said top member such that said switch control means is just above and shortly away from said induction board and may contact said induction board to close circuit thereof to emit preset sound and cause said bulbs to flash at random when said central switch control means is hit and therefore depressed by a dart.

2. A light and sound emittable dartsboard as claimed in claim 1 wherein said switch control means has a plurality of legs each of which has an elastic lower end and a conductive contact piece inside said elastic lower end at an adequate distance away from said elastic lower end.

3. A light and sound emittable dartsboard as claimed in claim 1 wherein said induction board has a micro control IC preset thereon and said micro control IC further includes an activation circuit, bulb driving circuit, sequence circuit, and time counting circuit.

4. A light and sound emittable dartsboard as claimed in claim 1 wherein said dartsboard has associated darts that each has a suction cup connected to the front head of the dart.

* * * * *